United States Patent [19]

Hase

[11] Patent Number: 4,907,423

[45] Date of Patent: Mar. 13, 1990

[54] INSULATED REFRIGERATED STORAGE CONTAINER

[75] Inventor: Gary Hase, Beecher, Ill.

[73] Assignee: H & R Industries, Inc., Beecher, Ill.

[21] Appl. No.: 252,676

[22] Filed: Oct. 6, 1988

[51] Int. Cl.[4] ..... F25D 3/12

[52] U.S. Cl. ..... 62/384; 62/388

[58] Field of Search ..... 62/78, 384, 387, 388, 62/457, 239

[56] References Cited

U.S. PATENT DOCUMENTS

| | | | |
|---|---|---|---|
| 2,070,044 | 2/1937 | Gilpin | 62/388 X |
| 3,163,022 | 12/1964 | Hottenroth | 62/388 X |
| 3,922,878 | 12/1975 | Jalali | 62/384 |
| 4,299,429 | 11/1981 | Franklin, Jr. | 62/388 X |
| 4,457,142 | 7/1984 | Bucher | 62/388 |
| 4,502,293 | 3/1985 | Franklin, Jr. | 62/388 |
| 4,741,167 | 5/1988 | Wigley | 62/388 X |
| 4,761,969 | 8/1988 | Moe | 62/388 |

OTHER PUBLICATIONS

H&R industries, Inc., "Insul-Stor Truck Bodies", (4 pages) (Dtd. 1/9/89).

H&R Industries, Inc., "Insul-Stor Containers", (2 pages) (Dtd. 1/9/89).

H&R Industries, Inc., "Insul-Stor Commercial Containers", (2 pages) (Dtd. 1/9/89).

*Primary Examiner*—Lloyd L. King

*Attorney, Agent, or Firm*—R. A. Blackstone, Jr.

[57] ABSTRACT

An insulated refrigerated storage container apparatus comprises a plurality of wall members defining a generally rectilinear enclosure and including respective top, bottom, front, rear and opposing side wall members. An access opening is provided in the front wall and an access door mounted to the access opening for selectively closing the same. A refrigerant compartment is located interiorly of the enclosure adjacent the top wall thereof. Channels are provided for directing a flow of refrigerated fluid from the refrigerant compartment over and around top, rear and bottom portions of the interior of the enclosure so as to substantially surround an interior volume defined within the enclosure with refrigerated fluid. An exhaust vent is located at a lower portion of the container for exhausting excess air and spent refrigerated fluid from the enclosure.

5 Claims, 2 Drawing Sheets

INSULATED REFRIGERATED STORAGE CONTAINER

BACKGROUND OF THE INVENTION

The present invention is directed to a novel and improved refrigerated insulated storage container.

Insulated storage containers are generally used for storage and transport of commodities or other goods which are required to be maintained at or near some given temperature or range of temperatures. Such goods or other commodities may be required to be at either relatively elevated or relatively reduced temperatures (i.e., refrigerated). Such containers are often used in transport of goods by truck, and their use permits the use of ordinary trucks or trailers. That is, use of such containers obviates the need for relatively expensive and complex refrigerated trucks, truck trailers or the like.

Generally speaking, urethane or similar insulation material is utilized in such containers to provide the required insulative qualities for maintaining the desired temperature of the goods to be stored or transported therein. Frequently such containers are provided with separate compartments or the like for carrying a quantity of dry ice or carbon dioxide ($CO_2$) as a coolant to aid in maintaining the desired temperature of cold goods or commodities during the storage or transport. In the case of the use of carbon dioxide as a refrigerant, the most efficient use of the material dictates that the carbon dioxide vapors be well distributed about the container and about the goods being carried therein.

Heretofore, such containers have been relatively simple in form, presenting generally flat, or smooth interior and exterior surface walls which enclose a quantity of insulation material therebetween. The containers may be either generally rectilinear or generally cylindrical in form, although the rectilinear containers are more frequently used in practice. Accordingly, prior art containers relied primarily upon the effects of gravity and to distribute the cold vapor and air about the container in goods being carried therein.

However, we have found a surprisingly simple and yet effective manner in which to better distribute carbon dioxide vapors about the interior of the container and thus generally about the goods or commodities being carried or stored therein. Moreover, we have devised a method for safely and effectively exiting or exhausting spent carbon dioxide vapor through a simple and yet effective exhaust vent provided in a lower portion of the container. Accordingly, our novel and improved container advantageously optimizes the use of carbon dioxide or, for that matter, of any refrigerant which may be selected for use therewith, by optimizing the air (vapor) flow around and about the interior of the container. Advantageously, our system of air (vapor) distribution about the interior of the container also obviates the need for more expensive and complex mechanical means, such as complex tubing, fans, pumps or the like, for accomplishing such air (vapor) or other refrigerant distribution.

Additionally, insulated storage containers have heretofore generally used a rigid front door usually hingedly attached to a front wall of the storage container for sealingly engaging and closing an access opening therein. Various latching and/or locking means are also employed for releasably latching and closing such doors. However, such doors often present externally protruding hinges, latch parts and the like, such that their use on the containers require some additional amount of floor space inside a semi-trailer or other truck during transit. Such protruding parts may be damaged during handling. Moreover, hinged doors may inadvertantly loosen and/or swing open during handling, as by forklift or the like. This may damage the container, the contents, the forklift, or indeed other equipment. It will be appreciated that such mishaps during handling diminish efficiency of plant operation, because they may require suspending operations in whole or in part and utilizing operating personnel for necessary clean up, repair and the like.

Advantageously, we have provided a further improvement upon prior art storage containers in the form of a flexible door member utilizing a velcro-type of sealing and closure arrangement for releasable closure relative to the container. Our flexible door may also advantageously be fitted substantially flush with the front of the container thus greatly saving required floor space inside of trucks or other trailer vehicles, by permitting such containers to be butted up substantially flush against one another. This also greatly reduces the risk of doors swinging open and causing damage to equipment during handling. Additionally, our flexible door member makes possible substantial weight savings over much heavier rigid door arrangements. Such weight savings can be particularly significant when large numbers of containers are being transported by truck or trailer.

OBJECTS AND SUMMARY OF THE INVENTION

Accordingly, it is a general object of this invention to provide a novel and improved insulated refrigerated storage container in accordance with the foregoing considerations.

Briefly, and in accordance with the foregoing, an insulated refrigerated storage container in accordance with the invention comprises a plurality of wall members defining a generally recilinear enclosure and including respective top, bottom, front, rear and opposing side wall members; an access opening in said front wall; an access door mounted to said access opening in said front wall for selectively closing the same; a refrigerant compartment located interiorly of said enclosure and a flow of refrigerated fluid from said refrigerant compartment over and around top, rear and bottom portions of the interior of said enclosure so as to substantially surround an interior volume defined within said enclosure with refrigerated fluid, and exhaust vent means located at a lower portion of said container for exhausing excess air and spent refrigerated fluid from said enclosure.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in which like reference numerals identify like elements, and in which:

DETAILED DESCRIPTION OF THE ILLUSTRATED EMBODIMENT

Figure 1:
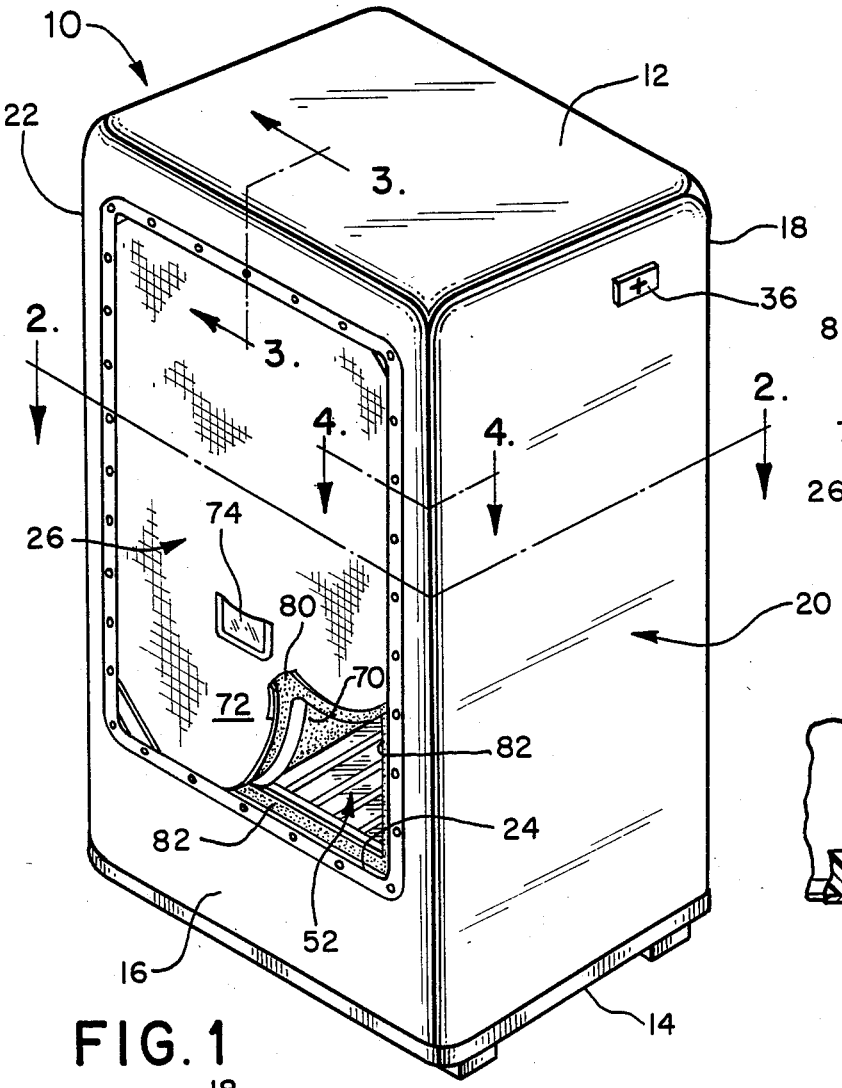
FIG. 1 is a perspective view of an insulated refrigerated storage container in accordance with a preferred embodiment of the invention.
Figure 7:
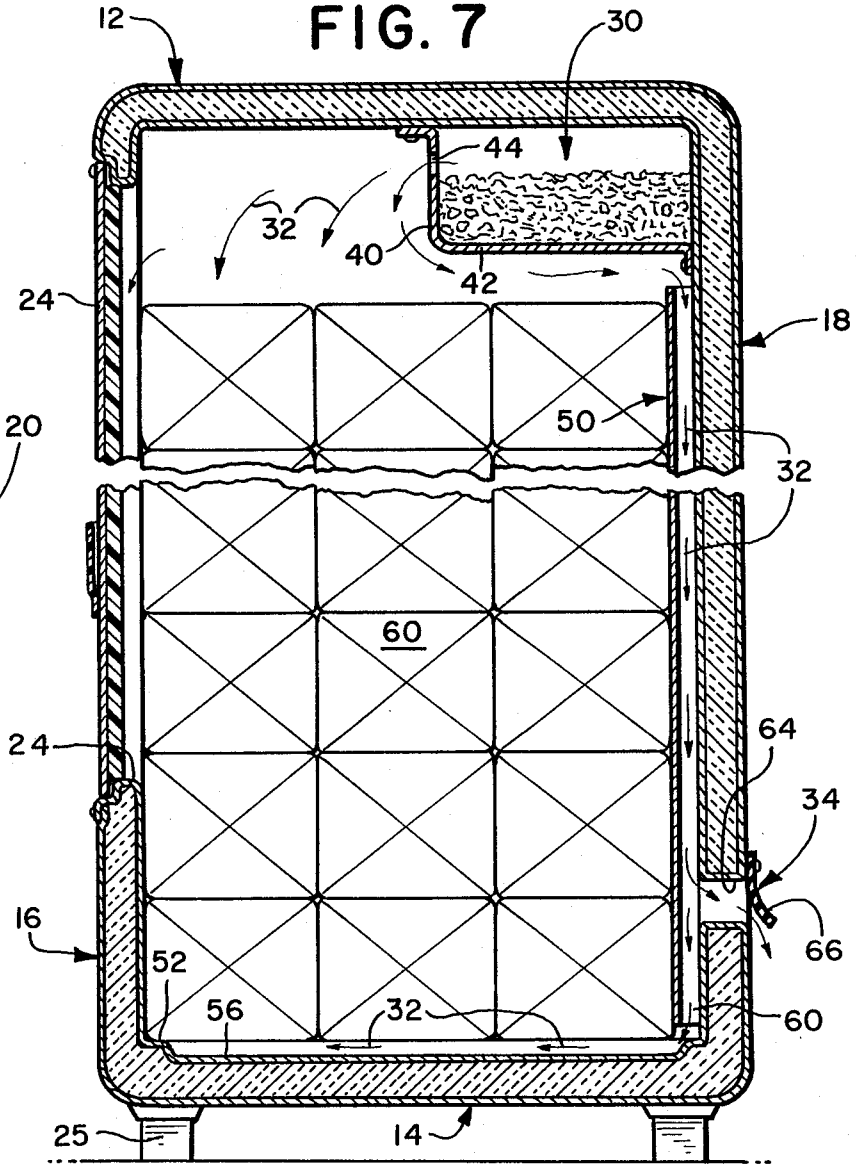
FIG. 7 is a sectional view, partially broken away, of the container of FIG. 1, taken generally in the plane of the line 7—7 of FIG. 2.
Figure 6:
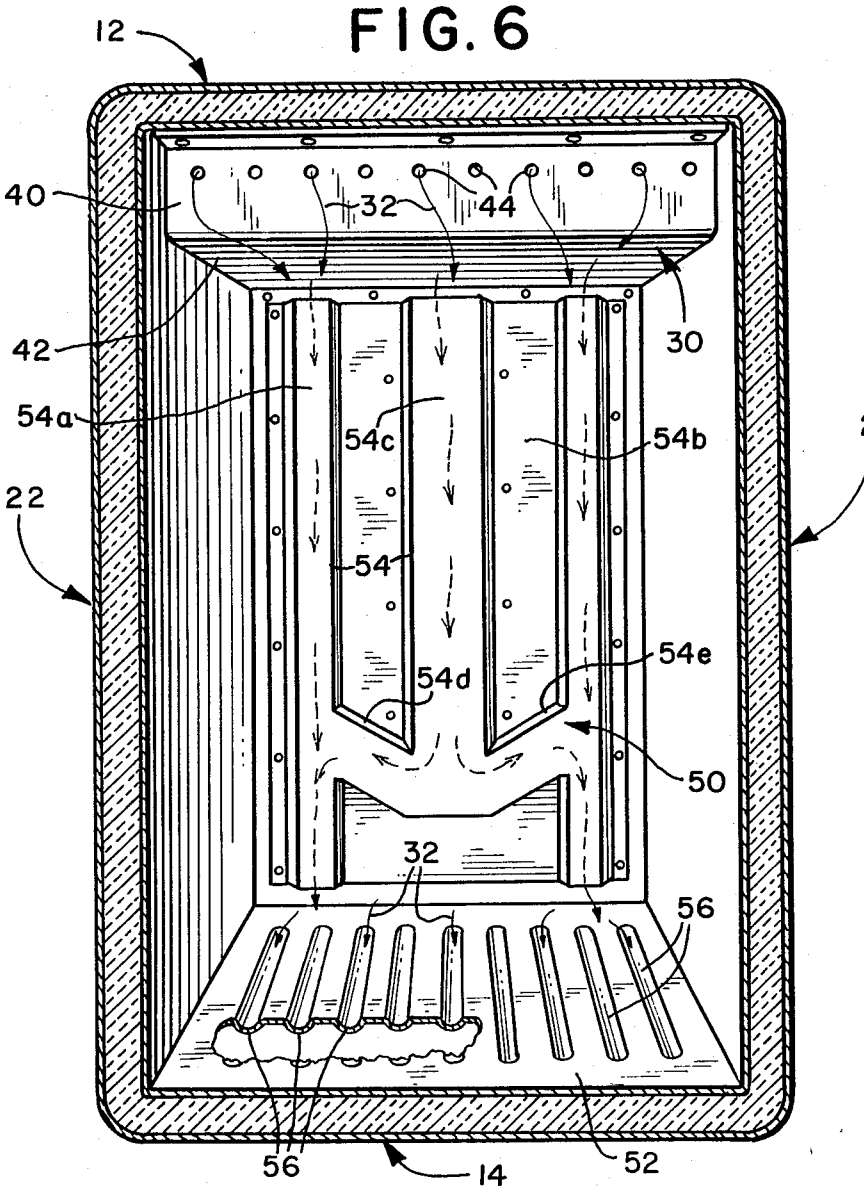
FIG. 6 is a sectional view of the storage container of FIG. 1, taken generally in the plane of the line 6—6 of FIG. 2.

Referring now to the drawings and initially to FIG. 1, an insulated refrigerated storage container in accordance with one embodiment of the invention is designated generally by the reference numeral 10. Referring also to FIGS. 6 and 7, the illustrated embodiment comprises a generally rectilinear enclosure which is defined by a plurality of wall members. These wall members comprise respective top and bottom wall members 12, 14, respective front and rear wall members 16, 18, and opposing side wall members 20, 22. In the illustrated embodiment, the container 10 is mounted on four cushioned legs or feet, preferably of a rubber or rubber-like material, and designated generally by the reference numeral 25. These legs or feet are attached to the bottom wall 14 to facilitate fork lift handling.

The front wall is provided with an access opening 24 which in the illustrated embodiment is generally rectilinear in form. An access door 26 is provided for selectively opening and closing the access opening 24. A refrigerant compartment 30 is located interiorly of the enclosure and generally adjacent an inner surface of the top wall 12 thereof.

In accordance with an important feature of the invention, means are provided for directing a flow of refrigerated air or other fluid (e.g., carbon dioxide vapor) from the refrigerant compartment 30 over and around the top, rear and bottom portions of the interior of the enclosure so as to substantially surround the interior volume defined within the enclosure with refrigerated air or other fluid. This directing of refrigerated fluid is indicated in FIGS. 6 and 7 generally by the arrows 32. Preferably, an exhaust vent or vent means 34 is located near a lower portion of the container, and preferably a lower portion of its rear wall 18 for exhausting spent refrigerated air or other fluid from the enclosure defined within the container.

Preferably, the refrigerant comprises carbon dioxide; however, other refrigerants may be utilized without departing from the invention. Preferably, this refrigerant is introduced into the refrigerant compartment 30 through an inlet valve or fitting 36, which is diagrammatically indicated in FIG. 1. This valve or fitting 36 is conveniently located on sidewall 20; however, the inlet fitting or valve may be located alternatively at opposite side wall 22, rear wall 18, or top wall 12 or any other suitable location for introducing refrigerant into compartment 30, without departing from the invention. The heavier-than-air carbon dioxide gas will tend to displace the air within the container, thus forcing air out of the exhaust vent or opening 34 as the heavier carbon dioxide gas descends over and around the interior of the container, by way of the fluid flow directing means as will be more fully described hereinbelow.

The refrigerant compartment 30 is defined by respective front and bottom walls 40, 42 both of which extend from side-to-side interiorly of the enclosure, that is, between the interior surfaces of respective side walls 20, 22. The refrigerant compartment front wall 40 depends downwardly from the interior of top wall 12 a minor fractional portion of the height of the enclosure. The refrigerant compartment rear wall extends forwardly of an interior surface of the enclosure rear wall 18 to meet the depending refrigerant compartment front wall 40. Moreover, the refrigerant compartment front wall is provided with a plurality of through openings 44 which comprise a portion of the above-mentioned fluid flow directing means.

The fluid flow directing means further include respective interior rear and bottom panels 50, 52. These rear and bottom panels 50, 52 are mounted to respective interior surfaces of the rear and bottom walls 18, 14. Each of these panels has a plurality of ribs 54, 56 which provide elongate channels or conduits for directing or permitting a flow of refrigerant therethrough. In the illustrated embodiment, the ribs 54 of rear panel 50 are raised such that they are spaced apart from the interior surface of rear wall 18. Thus, respective conduits for refrigerant are defined respectively between raised ribs 54 and rear wall 18. On the other hand, the ribs 56 of the bottom panel 52 are depressed, to provide channels or conduits generally between the bottoms of these ribs 56 and the facing surfaces of packages or other contents 60 of the container, to accommodate a flow of refrigerant therebetween.

Moreover, the ribs 54 of the rear panel run substantially from the top to the bottom of the rear panel. Cooperatively, the ribs 56 of the front panel run substantially from the back to the front of the panel such that the channels or conduits defined by the respective ribs communicate with each other, as indicated generally at arrow 60 and FIG. 7. Moreover, the exhaust vent 34 preferably communicates with one of the conduits defined by the ribs 54 of the rear panel. In the illustrated embodiment, the exhaust vent 34 comprises a through opening 64 in the rear wall 18 and a flexible flap member 66 covering the same. The flap 66 may also be held normally closed by a small magnet (not shown), when the exterior rear wall of the container is constructed of a ferromagnetic material.

In the embodiment illustrated, the rear panel ribs 54 comprise a pair of respective outer parallel spaced similar elongate ribs 54*a* and 54*b* and a centrally located rib 54*c*. Respective ribs 54*a* and 54*b* run from the top to the bottom of the panel 50. However, the rib 54*c* is approximately twice the width of ribs 54*a* and 54*b* and runs from an area adjacent the top of a panel to an area spaced slightly from the bottom of the panel 50. This central rib 54*c* is connected by a pair of diagonally extending intermediate connector ribs 54*d* and 54*e* to the respective outer ribs 54*a* and 54*b*. Preferably, the exhaust port 34 is located adjacent the area of rib 54*c* from which respective diagonal connector ribs 54*d* and 54*e* extend.

Figure 3:
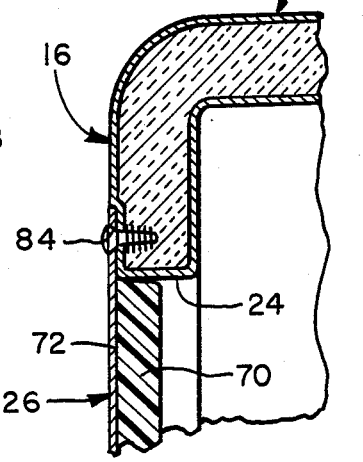
FIG. 3 is an enlarged partial sectional view taken generally along the line 3—3 of FIG. 1.
Figure 4:
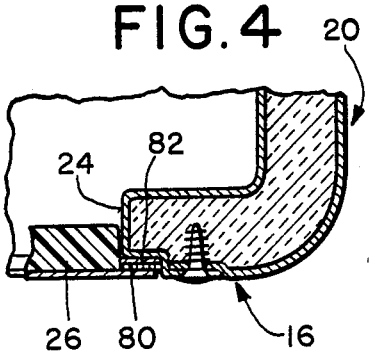
FIG. 4 is an enlarged partial perspective view taken generally along the line 4—4 of FIG. 1.
Figure 2:
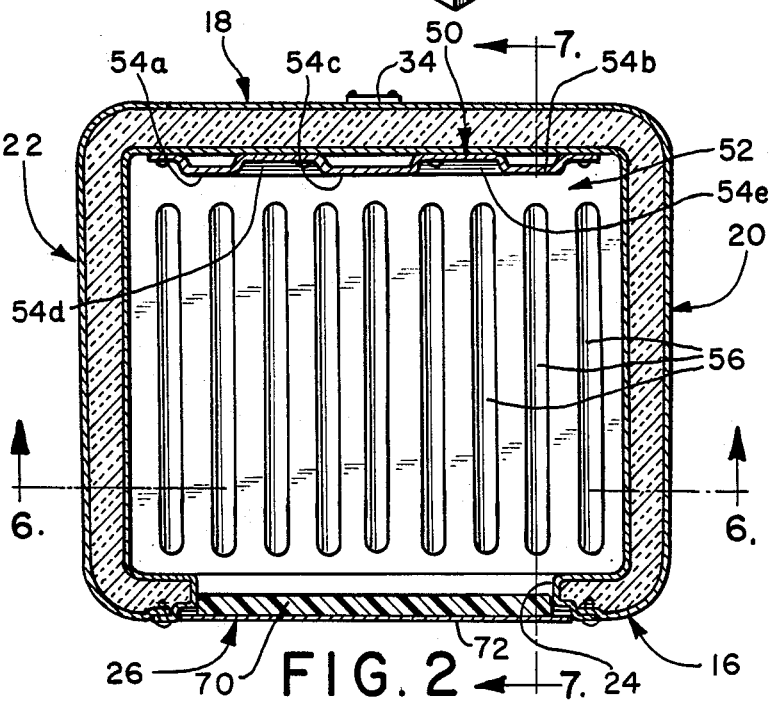
FIG. 2 is sectional view taken generally in the plane of the line 2—2 of FIG. 1.
Figure 5:
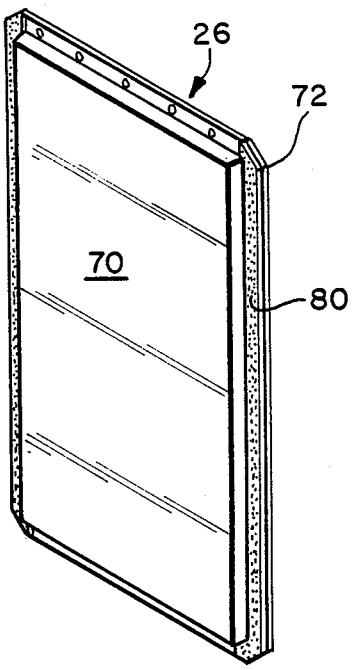
FIG. 5 is a perspective view of a flexible door member for the storage container in accordance with one embodiment of the invention.

In the embodiment illustrated herein, the access door 26 comprises a flexible door, preferably formed of a sheet of urethane foam or other suitable material 70 provided with a suitable abrasion resistant coating or backing 72, such as a heavy canvas material. A hand hold 74 may additionally be provided in the front surface thereof. Preferably, the flexible door 26 is substantially rectangular in form and is provided with releasable closure means. In the illustrated embodiment the closure is effected by means of strips of mating velcro-type material 80, 82 about the peripheries of at least three sides of the door 26 and of a facing surface or lip within the opening 24 for releasably closing the door relative to the opening 24 in the front wall 16. Preferably, the fourth and in the illustrated embodiment, topmost edge of the flexible door 26 is joined to the corresponding upper edge of opening 24 by suitable fasteners 84 (see FIG. 3).

In similar fashion, the container itself may be fabricated from a suitable insulating material such as a urethane material which is laminated or otherwise surrounded on all sides by a suitable protective covering such as a hardened plastic or metal material to form the interior and exterior surfaces thereof.

While particular embodiments of the invention have been shown and described in detail, it will be obvious to those skilled in the art that changes and modifications of the present invention, in its various aspects, may be made without departing from the invention in its broader aspects, some of which changes and modifications being maters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. An insulated refrigerated storage container apparatus comprising: a plurality of wall members defining a generally rectilinear enclosure and including respective top, bottom, front rear and opposing side wall members; a substantially rectangular access opening in said front wall; an access door mounted to said access opening in said front wall for selectively closing the same; a refrigerant compartment located interiorly of said enclosure and adjacent said top wall thereof, and means for directing the flow of refrigerated fluid from said refrigerant compartment over and around top, rear and bottom portions of the interior of said enclosure so as to substantially surround an interior volume defined within said enclosure with refrigerated fluid, and exhaust vent means located at a lower portion of said container for exhausting excess air and spent refrigerated fluid from said enclosure; wherein said access door comprises a flexible door member formed of a substantially rectangular sheet of pliable insulative material provided with an abrasion resistant backing, said backing being oriented to form an outer surface of the container when said door is closed, and means attaching said door along one edge thereof to a facing side of said access opening, and further including releasable closure means comprising a strip of releasable adhesive material running about the periphery of three other edges of said door facing said front wall member and a strip of complementary mating releasable adhesive material attached to facing surfaces of said front wall member about the other three sides of said access opening.

2. Apparatus according to claim 1 wherein said refrigerant compartment has respective front and bottom walls which extend from side-to-side interiorly of said enclosure, said compartment front wall depending from said enclosure top wall a minor fractional portion of the height of said enclosure, and said refrigerant compartment rear wall extending forwardly of said enclosure rear wall by a given proportion of the depth of said enclosure and to meet the refrigerant compartment front wall, and wherein said flow directing means includes a plurality of openings in said refrigerant compartment front wall.

3. An apparatus according to claim 1 wherein said flow directing means comprises respective interior rear and bottom panels respectively mounted to interior surfaces of said rear and bottom walls, each of said panels having a plurality of ribs therein which define respective conduits for accommodating a flow of fluid.

4. Apparatus according to claim 3 wherein said ribs on said rear panel run substantially from the top to the bottom of said rear panel and wherein said ribs of said bottom panel run substantially from the back to the front of said panel and wherein conduits defined by the rear panel communicate with conduits defined by the bottom panel.

5. Apparatus according to claim 3 wherein said exhaust vent communicates with at least one of the conduits formed by said ribs of said rear panel.

* * * * *